United States Patent [19]

Junker

[11] 4,282,670

[45] Aug. 11, 1981

[54] CONSUMABLE CASELESS AMMUNITION AND FIREARM FOR UTILIZING SAME

[75] Inventor: Ralph D. Junker, Columbus, N.C.

[73] Assignee: Junker Systems, Incorporated, Tryon, N.C.

[21] Appl. No.: 62,794

[22] Filed: Aug. 1, 1979

[51] Int. Cl.[3] ..... F41C 11/00; F41C 15/12; F42B 11/16

[52] U.S. Cl. ..... 42/16; 42/25; 102/573 102/573; 102/92.1; 102/92.6

[58] Field of Search ..... 42/16, 15, 18, 25; 102/38 CC, DIG. 1, 92.1–92.4, 92.6, 60, 87

[56] References Cited

U.S. PATENT DOCUMENTS

| | | | |
|---|---|---|---|
| 969,500 | 9/1910 | Silva | 42/15 |
| 2,632,391 | 3/1953 | Kintzinger | 42/18 |
| 3,474,560 | 10/1969 | Ramsay | 42/15 |
| 3,501,858 | 3/1970 | Hensley et al. | 42/16 |
| 3,667,147 | 6/1972 | Goldin et al. | 42/15 |
| 3,722,123 | 3/1973 | Parisi | 42/16 |
| 4,123,963 | 11/1978 | Junker | 42/16 |

*Primary Examiner*—Charles T. Jordan

*Attorney, Agent, or Firm*—Burns, Doane, Swecker & Mathis

[57] ABSTRACT

A firearm is disclosed for firing caseless ammunition. The firearm fires projectiles by ignition of a separate propellant cartridge disposed therebehind, the projectile carrying a primer charge for igniting the propellant cartridge. The firearm comprises a body including a receiver, a barrel connected to the receiver, and a firing chamber communicating with a bore of the barrel. A mechanism is provided for feeding a projectile and a propellant cartridge therebehind into the receiver. A bolt is slidably mounted in the body and includes laterally open pockets for receiving the fed projectile and cartridge and for advancing them to an armed position within the firing chamber. A portion of the bolt is arranged to ignite the primer charge when the projectile reaches the armed position. The primer charge is disposed within a metal casing, the latter being mounted by friction fit within a recess of the projectile. A sleeve formed of anti-friction material surrounds the primer casing to facilitate insertion of the primer casing into the recess. The primer casing may contain a slower burning tracer material disposed ahead of the primer charge and to be ignited thereby.

22 Claims, 6 Drawing Figures

CONSUMABLE CASELESS AMMUNITION AND FIREARM FOR UTILIZING SAME

BACKGROUND AND OBJECTS OF THE INVENTION

The present invention relates to firearms employing consumable, caseless ammunition.

Firearms utilizing caseless ammunition have been previously proposed as evidenced, for example, by U.S. Pat. No. 2,632,391 issued to Kintzinger on Mar. 24, 1953, and U.S. Pat. Nos. 4,020,741 and 4,123,963 issued to the present inventor on May 3, 1977 and Nov. 7, 1978, respectively. The disclosures of the latter two patents are incorporated herein by reference as if set forth at length. In U.S. Pat. No. 4,123,963 there is disclosed a firearm which employs a consumable, caseless propellant charge for propelling a projectile. The firearm includes a magazine for storing projectiles and propellant cartridges. A reciprocating bolt includes two laterally open pockets, a front one of which receives a projectile and a rear one of which receives a propellant cartridge during a forward stroke of the bolt. At the end of the forward stroke, a firing pin is pushed through the bolt to ignite a primer disposed within the propellant charge. The propellant charge deflagrates and ignition gas pressure is communicated to the rear of the projectile to propel the latter from the firearm.

Despite the advancement in the art represented by U.S. Pat. Nos. 4,020,741 and 4,123,963, room for improvement remains. For example, from a safety standpoint the presence of a primer within the propellant cartridge renders the cartridge more sensitive to ignition and thus difficult to manufacture and store. Moreover, a direct hit on the magazine of the firearm could produce primer actuated ignition of the cartridges.

It is, therefore, an object of the present invention to minimize or eliminate such problems.

It is another object to increase the operational safety of a firearm employing caseless ammunition as well as to render the ammunition safer to manufacture and store.

It is an additional object to enable a primer for a propellant charge to be enclosed within a protective casing right up to the moment of detonation.

SUMMARY OF THE INVENTION

These objects are achieved by the present invention which involves a firearm for firing projectiles by the ignition therebehind of a separate propellant cartridge, the projectile carrying a primer charge for igniting the propellant cartridge. The firearm comprises a body which includes a receiver, a barrel connected to the receiver, and a firing chamber communicating with a bore of the barrel. Mechanism is provided for introducing a projectile and a cartridge therebehind into the body. A bolt is slidably mounted in the body. The bolt includes laterally open pockets for receiving the introduced projectile and cartridge and for advancing them to an armed position within the firing chamber. A surface of the bolt is arranged to ignite the primer charge when the projectile is in the armed position.

In a separately significant aspect of the present invention, the projectile comprises a body, the body containing a recess at a rearward end thereof. A primer is mounted in the recess substantially coaxially relative to the axis of the projectile. The primer includes a casing and a primer charge contained therein.

Preferably, a sleeve formed of anti-friction material is interposed between the primer casing and a wall of the recess to minimize friction during insertion of the primer casing into the recess.

The primer casing may contain an ignitable tracer material located forwardly of the primer charge to be ignited by the ignited primer charge.

THE DRAWING

The objects and advantages of the invention will become apparent from the following detailed description of a preferred embodiment thereof in connection with the accompanying drawings in which like numerals designate like elements, and in which.

DETAILED DESCRIPTION OF PREFERRED EMBODIMENTS OF THE INVENTION

Figure 1:
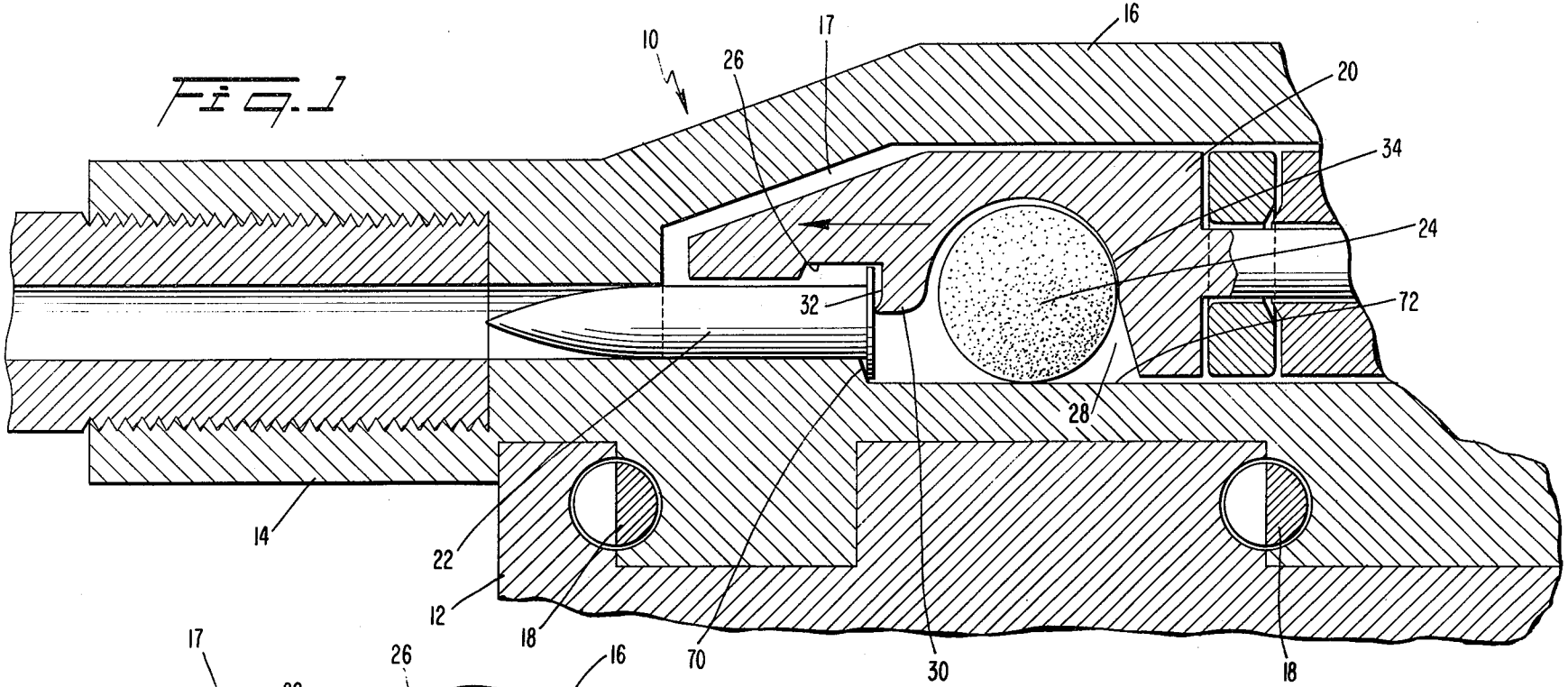
FIG. 1 is a longitudinal sectional view through a portion of a firearm according to the present invention depicting the moving bolt of the firearm in the act of positioning a projectile and propellant cartridge in an armed position within a firing chamber.

Depicted in FIG. 1 is a longitudinal section through a portion of a body of a firearm 10. The body includes a receiver 12 and a barrel 14, the latter including a barrel extension 16. The barrel extension, which forms a firing chamber 17, is secured to the receiver by conventional locking lugs 18.

A reciprocably mounted bolt 20 is adapted to shift a projectile 22 and a propellant cartridge 24 to an armed position within the firing chamber 17. At its forward end, the bolt 20 includes a pair of longitudinally spaced, laterally open front and rear pockets 26, 28 for the reception of the projectile and propellant cartridge, respectively. The projectile and propellant cartridge are housed within a magazine (not shown) which is carried by the receiver and which feeds laterally into the receiver bore. Any suitable mechanism can be provided for reciprocating the bolt and further details thereof are not needed herein. A suitable magazine is described in the fore-mentioned U.S. Pat. No. 4,123,963 of the present inventor.

The pockets 26, 28 of the bolt are separated by a divider lip 30, a surface 32 of which defines a rear wall of the front pocket 26 and engages the rear of the projectile to advance the latter. This lip 30 extends only partially across the juncture of the pockets so that the pockets are in continuous communication with one another. A forwardly facing wall 34 of the bolt 20 engages the back of the propellant cartridge 24 to advance the cartridge along with the projectile.

Figure 3:
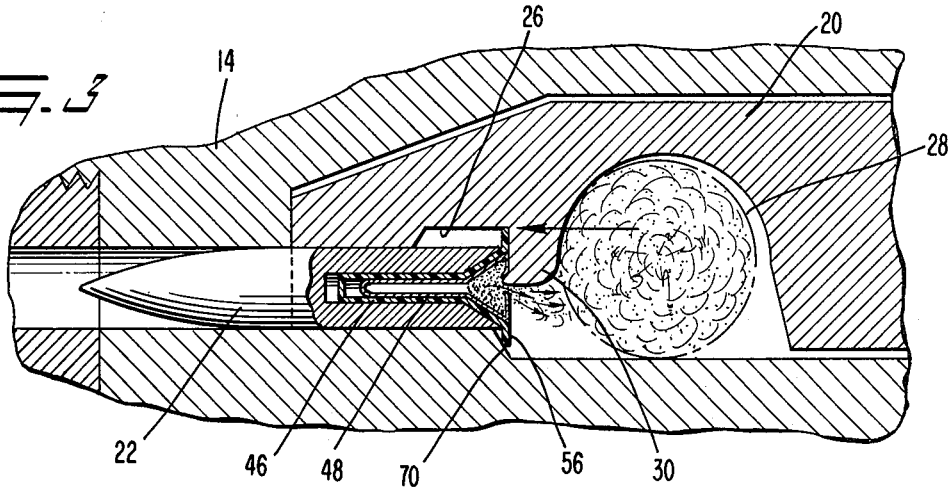
FIG. 3 is a view similar to FIG. 1 depicting a condition of the projectile at ignition.

When the projectile 22 and the propellant cartridge 24 are disposed in the firing position (FIG. 3), deflagration of the propellant charge produces high-pressure ignition gases which communicate with the rear of the projectile to expel the latter through the barrel.

The propellant cartridge 24 comprises a charge of conventional propellant material enveloped by a tough film of high nitrogen nitrocellulose which exhibits a high tolerance to heat and low moisture permeability. This film burns at rates commensurate with conventional gun powder without leaving an appreciable residue. Reference may be had to the inventor's U.S. Pat. No. 3,828,676 issued Aug. 13, 1974 for further details concerning the propellant cartridge. It is preferable that the propellant cartridge be of spherical configuration so as to perform a rolling motion as it is displaced forwardly within the firing chamber. Accordingly, contact of the cartridge with hot metal is minimal and variable along the surface of the propellant cartridge.

An important aspect of the present invention resides in the separation of the primer from the propellant cartridge, and provision for ignition of the primer by the bolt 20. In this regard, a primer charge is contained at the rear of each projectile 22 and is ignited by compression imposed by the front wall 32 of the divider lip, such wall thus constituting a firing surface.

Figure 5:
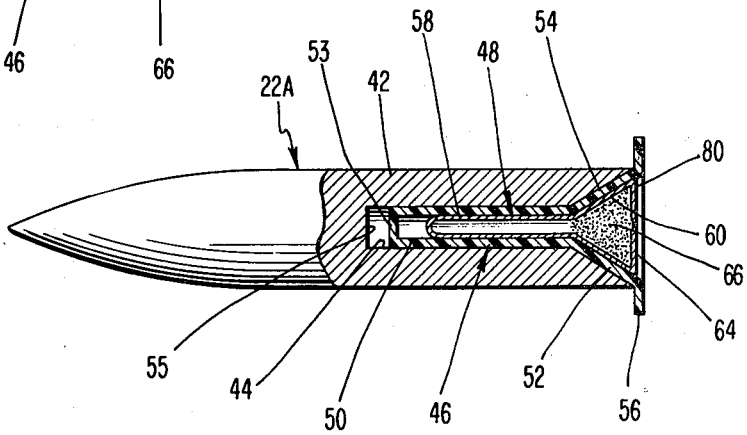
FIG. 5 is a longitudinal sectional view through an embodiment of a projectile according to the present invention.

One preferred projectile 22A according to the present invention is depicted in FIG. 5. The projectile 22A comprises a body 42 formed of conventional materials. An axial cylindrical recess 44 extends from a rear end of the body. Mounted in the projectile recess is a liner sleeve 46 and a primer casing 48. The sleeve 46 is preferably formed of an anti-friction plastic material such as nylon. A cylindrical nose portion 50 of the sleeve 46 projects into the recess 44 and a frusto-conical base portion 52 of the sleeve bears against a correspondingly flared rear surface 54 of the bore 44. The nose portion 50 includes a front wall 53 which terminates short of a front wall 55 of the projectile recess.

Projecting radially outwardly from the base portion 52 of the sleeve and beyond the periphery of the projectile body 42 is an annular rim portion 56 of the sleeve which functions in a manner to be described.

The primer casing 48 is preferably formed of a relatively soft metal such as brass or copper. A cylindrical nose portion 58 of the primer casing extends into the nose portion 50 of the sleeve 46 but terminates short of the forward end 53 of the latter. A base portion of the primer casing is of generally frusto-conical shape, including a forward surface 60 which bears against the frusto-conical base portion 52 of the sleeve 46, and an annular rear wall 64 disposed co-axially relative to the axis of the projectile.

A suitable conventional primer compound 66 is disposed in the base portion of the primer casing and is adapted to be ignited upon being actively compressed.

The sleeve 46 is mounted within the projectile recess 44 by friction fit, and the primer casing 48 is mounted within the sleeve 46 by friction fit. The presence of the anti-friction sleeve 46 minimizes friction during installation of the primer casing and thus reduces the chances that unintentional ignition of the primer may occur.

The firing chamber 17 of the firearm 10 includes a forwardly inclined stop surface 70 located on a bottom surface 72 of the firing chamber. The stop surface 70 coacts with the rim 56 of the projectile to enable the primer 66 to be ignited. It will be appreciated in this regard that as the projectile 22 is advanced by the bolt 20, contact of the rim 56 with the stop surface 70 halts travel of the projectile; further advancement of the bolt 20 results in the firing surface 32 pressing against the rear wall 64 of the primer casing and thus compressing the primer material 66 between the firing surface of the bolt and the rear surface 54 of the projectile body. Accordingly, the primer ignites and ignites the propellant cartridge. The resultant gases propel the projectile through the barrel.

Figure 4:
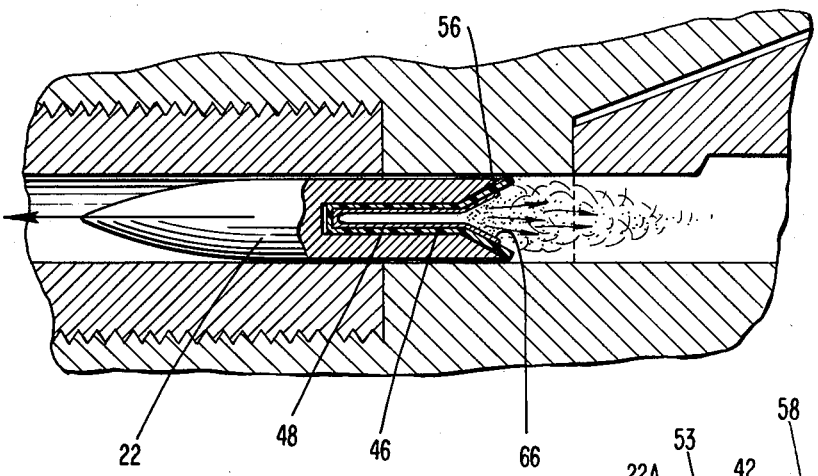
FIG. 4 depicts the projectile in transit in the bore.

In response to ignition of the primer, the primer casing is displaced forwardly within the sleeve 46, whereupon it impinges against the front wall 53 of the sleeve and drives the latter forwardly within the recess 44 to draw-in the rim 56 within the periphery of the projectile body, thereby streamlining the projectile for accurate travel (FIG. 4).

As the rim 56 initially contacts the stop surface 70, the rear end of the projectile 22 is cammed slightly upwardly. As a result, it is possible to arrange the firing surface 32 of the bolt 20 to contact essentially the outer edge 80 of the primer casing during advancement of the projectile, for maximized safety, whereafter the primer base will be cammed upwardly into a more effective position to be compressed by the firing surface 32.

Figure 2:
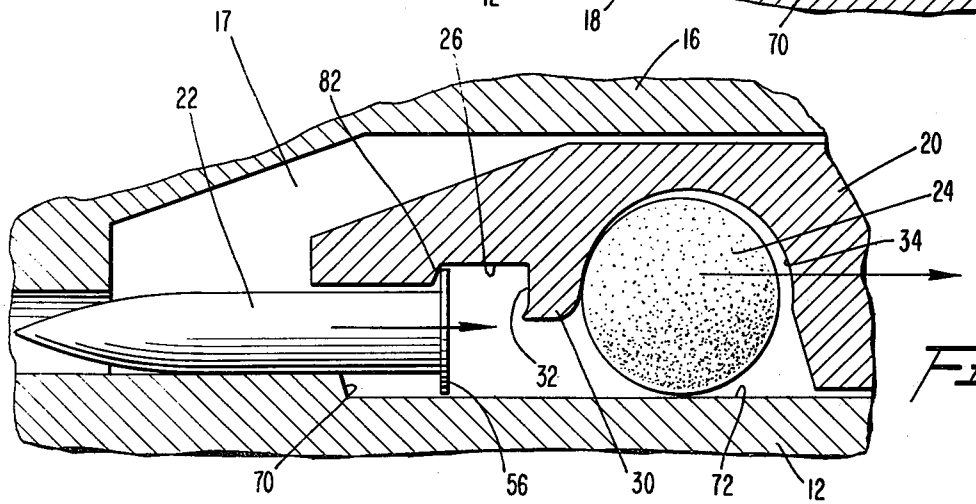
FIG. 2 is a view similar to FIG. 1 depicting extraction of an unfired projectile with bolt withdrawal.

Another function of the rim 56 of the sleeve is to provide for extraction of the projectile in the event that a misfire occurs or the firearm is to be disarmed. That is, retraction of the bolt 20 results in an extractor wall 82 of the front pocket 26 contacting the rim 56 and pulling the projectile 22 rearwardly to a location where it can be conveniently removed from the firearm (FIG. 2).

Figure 6:
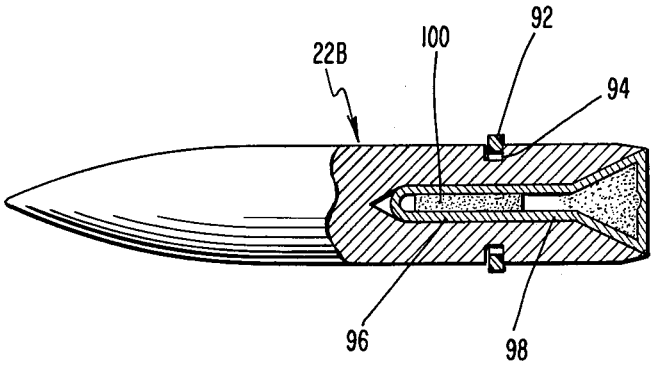
FIG. 6 is a longitudinal sectional view through another embodiment of the projectile according to the present invention.

Another preferred form of projectile 22B is illustrated in FIG. 6. In that embodiment, the liner sleeve has been omitted. A compressible O-ring 92, preferably formed of soft plastic, is disposed within an annular groove 94 in the peripheral wall of the projectile body. The O-ring 92 functions to engage the stop surface 70 and to be contacted by the extractor wall 82, much in the aforedescribed fashion relating to the rim 56. When the projectile is fired, the O-ring 92 is compressed into the groove 94 by the walls of the barrel bore as the projectile passes therethrough. Under these circumstances the compressible O-ring of slippery plastic serves to reduce barrel friction at the same time it enhances gas sealing or projectile obturation.

Disposed within a nose 96 of the primer casing 98 is a conventional tracer compound 100 which, when ignited, produces a visible light or vapor. Such tracer compound can be arranged so as to be ignited at a desired time interval after firing of the projectile to aid the shooter in evaluating the accuracy of the shot. Positioning of the tracer compound 100 inside of a primer-containing projectile provides advantages over conventional arrangements wherein a tracer material is applied to the outer periphery of the projectile and is ignited by friction generated as the projectile passes through the barrel bore. Such compounds have a corrosive effect upon the barrel bore. Moreover, the tracer creates an extended visible track upon exiting the barrel, thereby forming a path which may possibly be traced back to the shooter by the enemy.

By disposing the tracer compound within the projectile, to be ignited by the primer, in accordance with the present invention, ignition of the tracer compound can be delayed until well after the projectile has exited the firearm. The tracer compound 100 could, of course, be provided within the nose 58 of the primer casing described in connection with FIG. 5.

In operation, a forward stroke of the bolt 20 causes a projectile 22 and a propellant cartridge 24 to be displaced forwardly to a firing position within the firing chamber. As a front end of the projectile contacts the inclined stop surface 70, it rides thereover. Thereafter, as the projecting stop flange of the projectile, i.e., the rim 56 or the O-ring 92 of the preferred embodiments, contacts the inclined stop surface 70, forward movement of the projectile is halted, enabling the firing surface 32 on the bolt 20 to intensively compact the primer material 66 against the rear wall 54 of the projectile, thereby causing ignition of the primer material. Ignited primer material communicates with the second pocket 28 to ignite the propellant cartridge 24, thereby causing discharge of the projectile from the barrel.

In the event that the projectile is similar to that described in connection with FIG. 5, ignition of the primer material also causes the nose 58 of the primer casing to be rammed forwardly to displace the sleeve forwardly within the projectile bore to draw-in the flange radially inwardly, thereby streamlining the projectile.

If a tracer compound is positioned within the primer casing, it will be caused to ignite, preferably at some interval after the projectile has exited the barrel.

By virtue of the present invention, the advantages of employing consumable, casless ammunition are attained. Moreover, the primer is separated from the propellant charge, thereby maximizing the safety and stability of the propellant cartridge. Accordingly, the effects of a direct hit against a magazine of the firearm are not as dangerous. Moreover, the primer material is able to be safely encased in a metal casing and further protected by the walls of the projectile. Thus, both the propellant charge and the primer are more adequately protected against ignition outside the chamber.

By causing ignition of the primer by a surface of the bolt, rather than a separately actuated firing pin, the construction and operation of the firearm is greatly simplified and its reliability significantly increased.

By disposing the rear wall of the primer casing essentially coaxial with the projectile axis, a relatively large area is made available for contact by the firing surface, thereby lessening concern about alignment between the firing surface and the rear wall of the primer casing.

The primer casing itself is advantageous in that it can be utilized to house a separate tracer compound which is isolated from the wall of the barrel bore and is able to be ignited by the primer at a desired interval following exiting of the projectile from the firearm. Moreover, the primer casing may act as a power-driven ram to push the anti-friction sleeve forwardly within the projectile bore to draw-in the stop rim and thereby streamline the projectile.

The anti-friction sleeve interposed between the primer casing and the projectile bore minimizes the creation of frictional heat which would otherwise occur if the primer casing were installed while in direct contact with the wall of the projectile recess. Accordingly, fabrication of the projectiles can be accomplished under conditions of higher safety.

The exposed stop flange of the projectile functions not only to halt forward travel of the projectile within the firing chamber, thereby enabling ignition of the primer to be accomplished, but also enables the projectile to be extracted from the bore in the event that a misfire occurs, or it is desired to disarm the firearm.

Although the present invention has been disclosed in connection with firearms of the small arms type, it is to be understood that the invention is also applicable to an entire group of projectile-firing firearms including large guns employed aboard tanks, watercraft, aircraft and other vehicles.

Although the invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A firearm for firing projectiles by the detonation therebehind of a separate propellant cartridge, the projectile carrying a primer charge for igniting the propellant cartridge, said firearm comprising:

a body including a receiver, a barrel connected to said receiver, and a firing chamber communicating with a bore of the barrel;

means for introducing a projectile and a propellant cartridge therebehind into said body;

a bolt slidably mounted in said body, said bolt including laterally open pocket means for receiving said introduced projectile and cartridge and for advancing them to an armed position within said firing chamber;

a surface of said bolt being arranged to ignite said primer charge when said projectile is in said armed position.

2. Apparatus according to claim 1, wherein said pocket means comprises a first pocket for receiving said projectile and a second pocket disposed therebehind for receiving said propellant cartridge, said first and second pockets being in communication with one another, said surface of said bolt for igniting said primer charge comprising a rear surface of said first pocket.

3. Apparatus according to claim 2, wherein said first pocket includes a front surface adapted to engage a flange portion of said projectile to extract the latter rearwardly.

4. Apparatus according to claim 1, in combination with a projectile comprising a body, said projectile body containing a recess at a rearward end thereof; a metallic primer casing mounted in said recess and carrying a primer charge.

5. Apparatus according to claim 4, wherein said recess is enlarged at a rearward end thereof, said primer casing being correspondingly enlarged, said enlarged portion of said recess forming a surface against which the primer charge is compressed by said surface of said bolt.

6. Apparatus according to claim 4, wherein said projectile includes a sleeve formed of anti-friction material disposed between said primer casing and said projectile to minimize friction during insertion of said primer casing into said recess.

7. Apparatus according to claim 6, wherein said sleeve includes an annular rim projecting laterally beyond said projectile body.

8. Apparatus according to claim 7, wherein a forward portion of said sleeve terminates short of a forward end of said recess, said primer casing including a forward portion located behind said forward portion of said sleeve such that upon ignition of said primer charge, said primer casing is driven forwardly to displace said sleeve forwardly to draw-in said rim and streamline the projectile.

9. Apparatus according to claim 4, wherein said primer casing contains an ignitable tracer material forwardly of said primer charge to be ignited by the ignited primer charge.

10. Apparatus according to claim 1 in combination with a projectile comprising a body having an outer periphery, and a rim formed of anti-friction material projecting radially beyond said outer periphery, said rim being engageable with a portion of said firearm body to locate said projectile in its firing position, said rim being engageable by a portion of said bolt upon retraction of the latter to extract said projectile from its firing position, said rim constituting a lubricant and an obturation seal for said projectile as the latter is expelled from said bore.

11. Apparatus according to claim 4, wherein said primer means is arranged substantially coaxially relative to the axis of said projectile.

12. A projectile for use in a firearm in which a separate solid propellant charge is ignited behind the projectile to propel the latter through a barrel, said projectile comprising:

a body, said body containing a recess at a rearward end thereof;

primer means mounted in said recess substantially coaxially relative to the axis of said projectile, said primer means including a metallic casing and a primer charge contained therein.

13. Apparatus according to claim 11, wherein said recess is enlarged at a rearward end thereof, said casing being correspondingly enlarged, said enlarged portion of said recess forming a surface against which the primer charge can be compressed.

14. Apparatus according to claim 11, including a sleeve formed of anti-friction material disposed between said primer casing and a wall of said recess to minimize friction during insertion of said primer casing into said recess.

15. Apparatus according to claim 13, wherein said sleeve includes an annular rim projecting laterally beyond said projectile body.

16. Apparatus according to claim 14, wherein a forward portion of said sleeve terminates short of a forward end of said recess, said primer casing including a forward portion located behind said forward portion of said sleeve such that upon ignition of said primer charge, said primer casing is driven forwardly to displace said sleeve forwardly to draw-in said rim and streamline the projectile.

17. Apparatus according to claim 11, wherein said primer casing contains an ignitable tracer material forwardly of said primer charge to be ignited by the ignited primer charge.

18. A projectile for use in a firearm in which a separate solid propellant charge is ignited behind the projectile to propel the latter through a barrel, said projectile comprising:

a body, said body containing a recess at a rearward end thereof;

primer means mounted in said recess, said primer means including a casing and a primer charge contained therein; and a sleeve formed of anti-friction material disposed in said recess between said primer casing and a wall of said recess to facilitate insertion of said primer casing into said recess.

19. Apparatus according to claim 17, wherein said recess is enlarged at a rearward end thereof, said casing being correspondingly enlarged, said enlarged portion of said recess forming a surface against which the primer charge can be compressed.

20. Apparatus according to claim 17, including a sleeve formed of anti-friction material disposed between said primer casing and a wall of said recess to minimize friction during insertion of said primer casing into said recess.

21. A projectile for use in a firearm in which a separate solid propellant charge is ignited behind the projectile to propel the latter through a barrel, said projectile comprising:

a body, said body containing a recess at a rearward end thereof;

primer means mounted in said recess, said primer means including a casing and a primer charge contained therein, and a slow burning tracer charge disposed in said recess ahead of said primer charge to be ignited by ignited primer charge.

22. A projectile for use in a firearm of the type comprising a body including a receiver, a barrel connected to said receiver, and a firing chamber communicating with a bore of the barrel; and a bolt slidably mounted in said body for advancing the projectile to an armed position within said firing chamber, said projectile comprising a body having an outer periphery, and a rim formed of anti-friction material projecting radially beyond said outer periphery, said rim being engageable with a portion of said firearm body to locate said projectile in its firing position, said rim being engageable by a portion of said bolt upon retraction of the latter to extract said projectile from its firing position, said rim constituting a lubricant and an obturation seal for said projectile as the latter is expelled from said bore.

* * * * *